US006072286A

United States Patent [19]

Sears

[11] Patent Number: 6,072,286

[45] Date of Patent: Jun. 6, 2000

[54] AUXILIARY LIGHTING CONTROL CIRCUIT AND METHOD FOR A HID LAMP LIGHTING SYSTEM

[75] Inventor: Lawrence M. Sears, Hunting Valley, Ohio

[73] Assignee: Advanced Lighting Technologies, Inc., Twinsburg, Ohio

[21] Appl. No.: 08/899,881

[22] Filed: Jul. 24, 1997

[51] Int. Cl.[7] ..... H05B 41/46

[52] U.S. Cl. ..... 315/313; 315/92; 315/250; 315/245; 315/307

[58] Field of Search ..... 315/245, 92, 145, 315/313, 250, DIG. 5, 312, 258, 307, 308, 129, 136, 324

[56] References Cited

U.S. PATENT DOCUMENTS 3,599,036 8/1971 Haymaker ..... 315/136
3,611,432 10/1971 Babcock ..... 315/136
4,005,331 1/1977 Horowitz ..... 315/136
4,996,463 2/1991 Horowitz ..... 315/313

*Primary Examiner*—Don Wong
*Assistant Examiner*—Wilson Lee
*Attorney, Agent, or Firm*—Rogers & Killeen

[57] ABSTRACT

An auxiliary lighting control circuit and method for a lighting system having a HID lamp as the primary light source and an auxiliary light source for providing light when the HID lamp is extinguished or below full brightness but power remains available to the circuit. The circuit senses the HID lamp current and activates a relay to a conductive state using a solid state controller when the HID lamp current is below a predetermined current magnitude to effect the lighting of the auxiliary light source.

48 Claims, 3 Drawing Sheets

AUXILIARY LIGHTING CONTROL CIRCUIT AND METHOD FOR A HID LAMP LIGHTING SYSTEM

BACKGROUND OF THE INVENTION

The present invention relates generally to starting and operating circuits for lighting systems including a high intensity discharge ("HID") lamp and, more particularly, to auxiliary lighting control ("ALC") for such circuits for automatically lighting an auxiliary light source when desired.

Generally, HID lamps will extinguish when power to the lamp is interrupted. Power interruptions of even a very short duration, e.g., tens of milliseconds, will often extinguish the lamp. As is well known, generally, an extinguished HID lamp will not immediately reignite upon the restoration of power to the lamp as cooling of the gases within the lamp is required before the lamp will reignite. Further, when the lamp is reignited, its lumen output is usually only a fraction of normal and gradually increases until the lamp is at full brightness.

Typically, it may take several minutes upon restoration of power to the HID lamp before the lamp is at full brightness. Accordingly, ALC circuitry has been used for automatically lighting an auxiliary light source, such as an incandescent lamp, following a brief power interruption of an HID lamp.

During normal operation of a lighting system comprising an HID lamp and an auxiliary lamp (controlled by the ALC), the HID lamp is ON (energized) and the auxiliary lamp is OFF (deenergized). Typically, the primary winding of a current transformer is series connected with the HID lamp. The ALC senses the ON/OFF condition of the HID lamp by sensing the HID lamp current. The HID lamp current through the primary winding induces a proportional current in the secondary winding of the current transformer.

In prior art ALCs, a relay is maintained in an activated, non-conductive state by the current induced in the secondary winding of the current transformer. The relay operates to isolate power from the auxiliary lamp when in a non-conductive state so that the auxiliary lamp is OFF when HID lamp current is present, i.e., when the HID lamp is ON. When power is interrupted causing the HID lamp to extinguish, the relay is deactivated to a conductive state so that the auxiliary lamp will energize when power is restored to the lighting system.

Thus, typical prior art ALCs operate with a normally closed relay, i.e., a relay which is activated to a non-conductive state to isolate power to the auxiliary lamp and which fails to a conductive state energizing the auxiliary lamp. Faults in such circuits are likely to result in the relay deenergizing to a conductive state or becoming stuck in the conductive state energizing the auxiliary lamp simultaneously with the HID lamp for lengthy periods of time. Such a condition is undesirable because of potential ballast failure in the lamp circuitry.

Further, in such typical prior art circuits, the auxiliary lamp will energize when power is initially applied to the circuit, i.e., a "cold" start of the HID lamp. It is desirable to minimize the time the auxiliary lamp is ON unnecessarily to prolong the life of the lamp and conserve energy.

Many prior art ALCs provide a time delay using a temperature sensitive resistor to keep the auxiliary lamp energized during hot restart of the HID lamp until the HID lamp reaches full brightness. These time delays are susceptible to unpredictable operation due to changes in temperature and duty cycle.

Further, in the prior art ALCs, the current transformer must be sufficiently large so that its output at the secondary winding is sufficient to drive the electromagnetic relay or operate a switch, such as a triac, to apply power to the relay. Such current transformers are costly and bulky. It is desirable therefore, to minimize the size of the current transformer to save costs in the manufacture of such ALCs.

Accordingly, it is an object of the present invention to provide a novel ALC for a HID lighting system and a novel method of controlling an auxiliary light source in a HID lighting system.

It is another object of the present invention to provide a novel ALC and method, providing a normally open electromagnetic relay which fails "safe" to eliminate potential ballast failure caused by simultaneous operation of the HID lamp and the auxiliary lamp.

It is another object of the present invention to provide a novel ALC and method using a solid state control circuit to activate and deactivate the electromagnetic relay.

It is yet another object of the present invention to provide a novel ALC and method in which the auxiliary lamp will not energize during a cold start of the HID lamp.

It is still another object of the present invention to provide a novel ALC and method with reliable and predictable operation which is not influenced by temperature or duty cycle.

It is a further object of the present invention to provide a novel ALC and method which minimizes the size and cost of the current transformer.

It is yet a further object of the present invention to provide a novel ALC and method which protects semiconductor components from power transients.

It is still a further object of the present invention to provide a novel ALC and method which provides a low voltage d.c. power supply to operate components.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
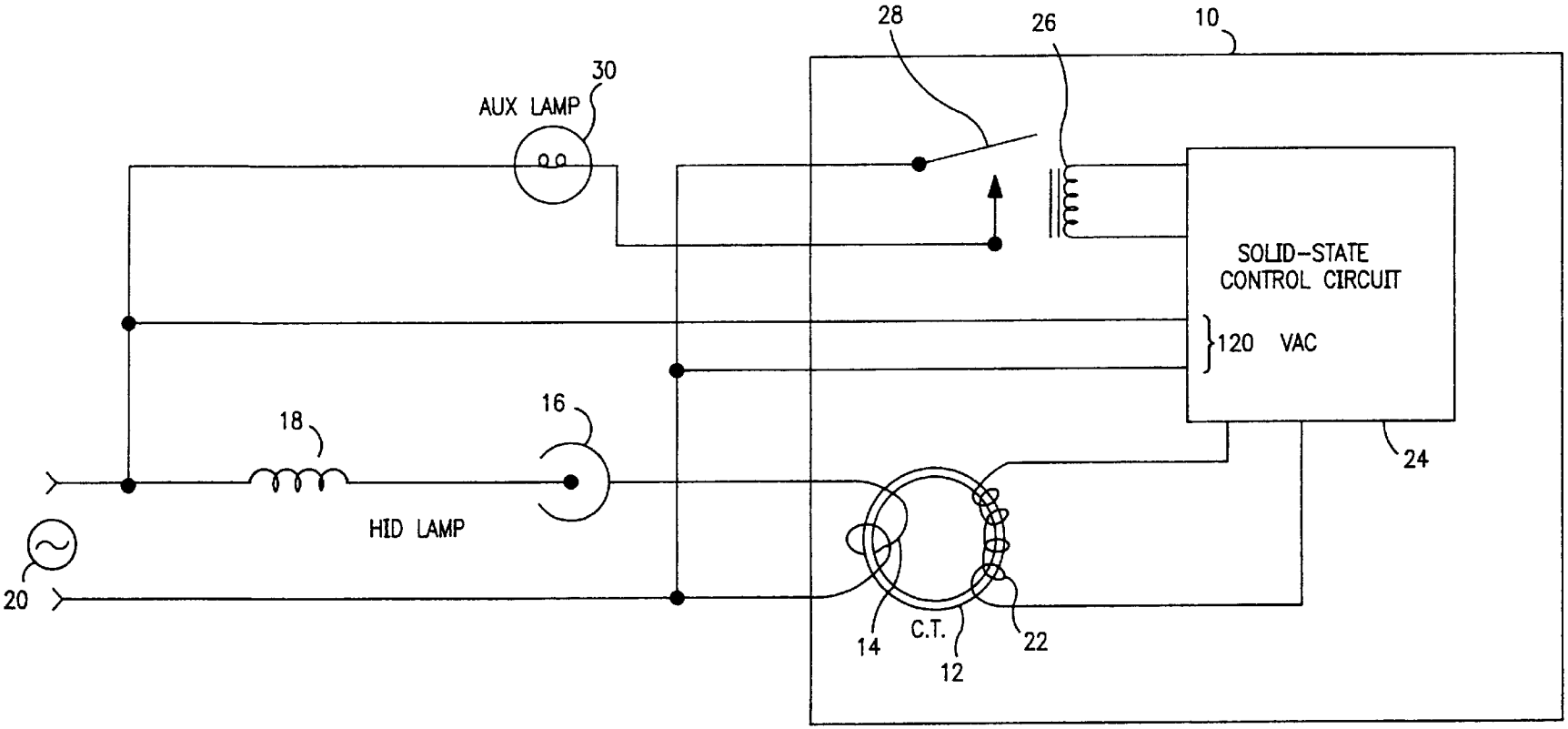
FIG. 1 is a simplified circuit diagram of an embodiment of a circuit in accordance with the present invention.

With reference to FIG. 1, ALC 10 comprises current transformer 12 having a primary winding 14 series connected to HID lamp 16, ballast 18, and a.c. power supply 20; and a secondary winding 22. Solid state control circuit 24 is operatively coupled to secondary winding 22, a.c. power supply 20, and normally open electromagnetic relay 26. Relay contacts 28 are series connected to auxiliary lamp 30 and a.c. power supply 20.

During normal operation with HID lamp 16 energized from a.c. power supply 20 through ballast 18 in an ON condition, the current conducting through HID lamp 16 conducts through primary winding 14 of current transformer 12 generating a current in secondary winding 22 which is proportional to the current conducting through HID lamp 16. ALC 10 thus "senses" HID lamp current using current transformer 12 which electrically isolates ALC 10 from the HID lamp current. By electrically isolating the ALC from HID lamp current, one model ALC may be universally used, i.e., one model ALC will work with any HID lamp circuit regardless of circuit configuration, lamp type, or ballast type. The circuit may also have isolated a.c. power contacts providing the additional versatility of having common (as shown in FIG. 1) or separate a.c. power supplies as desired.

Solid state control circuit 24 operates to effect the application of power to relay 26 to thereby effect the activation of relay 26 and the closing of contacts 28 during the absence of HID lamp current or when HID lamp current is less than a predetermined value. When contacts 28 are closed, auxiliary lamp 30 is energized by a.c. power supply 20 to an ON condition.

Solid state control circuit 24 operates to prevent the application of power to relay 26 to thereby effect the deactivation of relay 26 and the opening of contacts 28 during the presence of HID lamp current or when HID lamp current is above a predetermined value. When contacts 28 are open, auxiliary lamp 30 is deenergized to an OFF condition.

Because ALC 10 operates with normally open electromagnetic relay 26 which must be activated to close contacts 28 and energize auxiliary lamp 30, ALC 10 operates in a fail "safe" manner virtually eliminating potential ballast failure by reducing the likelihood that both HID lamp 16 and auxiliary lamp 30 will operate in an ON condition simultaneously for a prolonged period of time.

Figure 2:
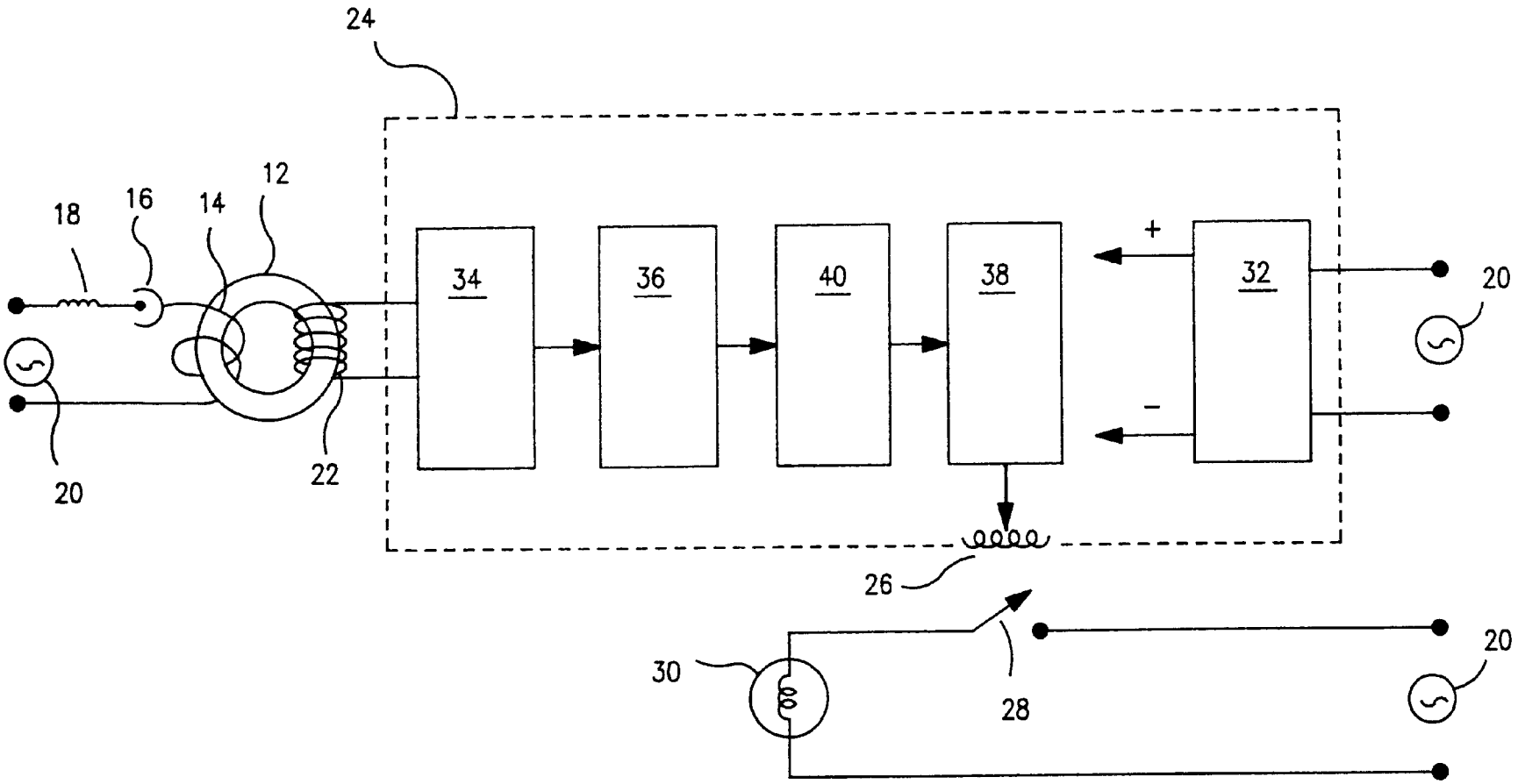
FIG. 2 is a simplified circuit diagram of another embodiment of a circuit in accordance with the present invention.

With reference now to FIG. 2, wherein like elements are given like reference numerals to the elements of FIG. 1, a solid state control circuit 24 may comprise:

(a) low voltage regulated d.c. power supply 32 which receives power from a.c. power supply 20 and provides a positive and a negative regulated d.c. voltage to power the remaining circuitry;

(b) amplifier 34 which is a high-gain low-impedance amplifier that reduces high frequency noise and is operatively coupled to secondary winding 22 to provide a HID lamp current sense signal when HID lamp current is greater than a predetermined value;

(c) detector 36 which operates in a conductive state when the HID lamp current sense signal is provided by amplifier 34, and operates in a non-conductive state when the HID lamp current sense signal is not provided by amplifier 34;

(d) relay driver 38 which operates in a conductive state to effect the application of power from d.c. power supply 32 to relay 26 when detector 36 is in a non-conductive state to thereby close contacts 28 to energize auxiliary lamp 30 from a.c. power supply 20, and is in a non-conductive state to prevent the application of power from d.c. power supply 32 to relay 26 when detector 36 is in a conductive state to thereby open contacts 28 to deenergize auxiliary lamp 30; and (e) time delay means 40 which operates to delay relay driver 38 from operating in a conductive state during cold start of HID lamp 16 so that relay driver 38 is not always but substantially always in a conductive state when detector 36 is in a non-conductive state, and operates to delay deenergizing auxiliary lamp 30 upon a hot restart of HID lamp 16 until HID lamp 16 reaches full brightness so that relay driver 38 is not always but substantially always in a non-conductive state when detector 36 is in a conductive state.

Figure 3:
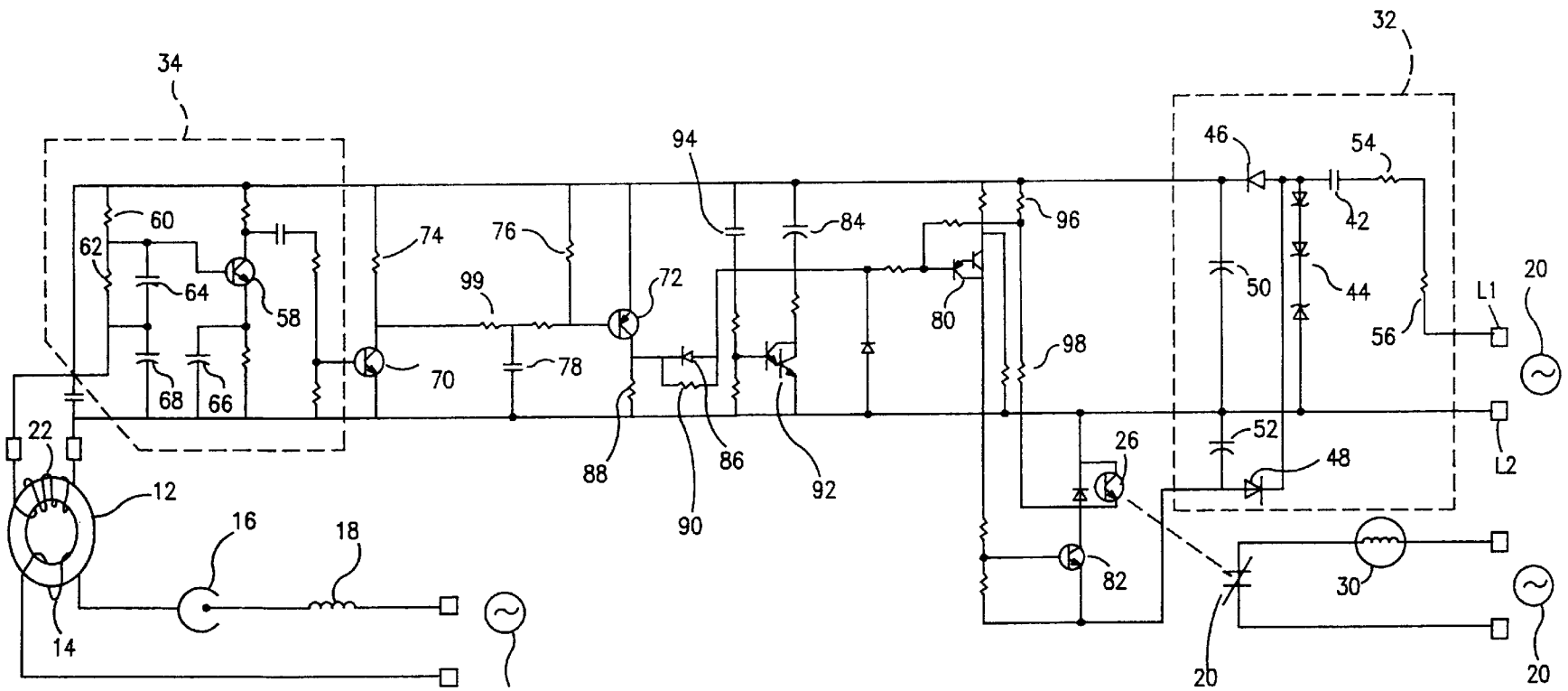
FIG. 3 is a circuit diagram of another embodiment of a circuit in accordance with the present invention.

With reference now to FIG. 3, a d.c. power supply 32 includes input terminals L1,L2 which are adapted for connection to an a.c. power supply such as a.c. power supply 20. Capacitor 42 is connected to terminal L1 and provides impedance to reduce the a.c. line voltage from a.c. power supply 20. Zener diode string 44 connected between capacitor 42 and terminal L2 clamps the a.c. line voltage to a predetermined value as the a.c. voltage follows a sinusoid to provide limited d.c. voltage. In a preferred embodiment, the a.c. voltage is clamped to +12 volts and to −24 volts. Diodes 46,48 peak detect the positive and negative line voltages which charge capacitors 50,52 to provide regulated positive and negative d.c. voltages to power the remaining circuitry of solid state control 24.

Resistors 54,56 limit current surges during application of power to the circuit and a.c. line voltage transients. Zener diode string 44 is in a shunt configuration which provides protection from significant a.c. line voltage transients to the components in solid state control circuit 24 allowing the use of semiconductors. Resistors 54,56 also prevent transients from overcharging capacitor 42.

As can be seen, the d.c. power supply produces a "split" d.c. voltage, i.e., both positive and negative rail voltages.

The split d.c. voltage provides maximum efficiency by full wave rectifying the a.c. voltage supply. Also, the availability of two independent d.c. supplies provides a low ripple supply for sensitive low-current circuitry, and a separate high current supply is available when higher ripple can be tolerated. This allows the use of smaller filter capacitors than would otherwise be required.

Amplifier 34 is a high-gain low-impedance a.c. amplifier. Transistor 58 is biased active by resistors 60,62. Capacitors 64,66 provide high a.c. gain and capacitor 68 reduces high frequency noise.

Amplifier 34 is operatively coupled to secondary winding 22 to provide a HID lamp current sense signal when HID lamp current is greater than a predetermined value. When HID lamp current is greater than the predetermined value, amplifier 34 output at the collector of transistor 58 is a nominal sinusoid which is capacitively coupled to transistor 70 to produce a rectangular rail-to-common waveform at the collector of transistor 70.

Detector 36 comprises transistor 72 which is in a non-conductive state (OFF) when the rectangular waveform is not present at the collector of transistor 70, i.e., HID lamp current is below the predetermined value (HID lamp 16 is OFF), because resistors 74,76 keep capacitor 78 charged to the positive rail voltage. When the rectangular waveform is present at the collector of transistor 70, i.e., HID lamp 16 is ON, the voltage at capacitor 78 drops and transistor 72 operates in a conductive state (ON). The collector of transistor 72 is pulled to the positive rail voltage. Thus, when HID lamp 16 is ON, detector 36 is ON or in a conductive state.

The time delay provided by resistor 99 and capacitor 78 eliminate false turn-on of transistor 72 due to lamp starting pulses or spurious glow currents.

Relay driver 38 comprises Darlington pair 80 which operates in a conductive state (ON) to thereby effect transistor 82 to operate in a conductive state (ON). With transistor 82 ON, power is applied to relay 26 from d.c. power supply 32 to activate relay 26 to thereby close contacts 28 to energize auxiliary lamp 30 from a.c. power supply 20. When Darlington pair 80 is in a non-conductive state (OFF), transistor 82 is OFF preventing the application of power to relay 26 to thereby effect the opening of contacts 28 to deenergize auxiliary lamp 30.

Capacitor 84 is charged to a voltage above a predetermined value to effect the operation of Darlington pair 80 in a conductive state (ON). Capacitor 84 is fully charged when transistor 72 is OFF because diode 86 pulls the negative side of capacitor 84 to ground. Thus, Darlington pair 80 is ON (and lamp 30 is ON) when transistor 72 is OFF (and HID lamp 16 is OFF).

Positive feedback is provided by resistors 96,98 to eliminate chatter of relay 26 at the ripple frequency.

Time delay means 40 comprises capacitor 84.

During initial power-up of the circuit, i.e., a "cold" start when HID lamp 16 has been extinguished for an extended period of time, capacitor 84 has zero voltage and relay 26 is OFF (lamp 30 is OFF). Assuming that HID lamp 16 does not start instantly, transistor 72 is OFF and capacitor 84 will charge via resistor 88 and diode 86 and will be charged to a voltage greater than the voltage required to turn ON Darlington pair 80 (and thus lamp 30) in about 5–10 seconds. However, HID lamp 16 starts within a few seconds and transistor 72 will turn ON to effect the discharging of capacitor 84 via transistor 72 and resistor 90 preventing capacitor 84 to charge to a sufficient voltage to turn on Darlington pair 80 (and lamp 30). Thus, the time constant of resistor 88 and capacitor 84 act as a time delay to prevent energizing lamp 30 during cold start of HID lamp 16.

This time delay may be overridden by including an optional overriding means comprising Darlington pair 92 and capacitor 94. With the overriding means included, when power is applied to cold start HID lamp 16, capacitor 94 provides a pulse of current to turn Darlington pair 92 ON which pulls capacitor 84 to ground before HID lamp 16 starts and transistor 72 turns ON. The charge on capacitor 84 turns Darlington pair 80 ON and thus turns lamp 30 ON.

During operation with HID lamp 16 ON, when a power interruption, which may be as brief as tens of milliseconds, extinguishes HID lamp 16, transistor 72 turns OFF. When power is restored, capacitor 84 quickly charges (in about three seconds) via resistor 88 and diode 86 to a voltage sufficient to turn Darlington pair 80 ON. Lamp 30 is ON and HID lamp 16 is OFF because it must cool sufficiently to reignite. When HID lamp 16 reignites, transistor 72 turns ON and begins to discharge capacitor 84 via resistor 90. In about 1–2 minutes, capacitor 84 has discharged sufficiently so that Darlington pair 80 turns OFF to thereby effect turning OFF lamp 30. Thus capacitor 84 provides a time delay to allow HID lamp 16 to reach full brightness after a hot restart before auxiliary lamp 30 turns OFF.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. An electrically isolated, universal auxiliary lighting control circuit suitable for use with different HID lamp types with a wide range of voltages connected in series with an a.c. power source and in parallel with a series connected auxiliary lamp and electromagnetic relay contacts comprising:

(a) a current transformer having a primary winding in series with said HID lamp and a secondary winding operable to sense the passage of current through said HID lamp; and (b) a solid state control circuit non-responsive to HID lamp voltage operatively connected to said a.c. power source and to said secondary winding to effect the application of power to said electromagnetic relay to thereby effect the closing of said contacts during the absence of current in said HID lamp, and to prevent the application of power to said electromagnetic relay to thereby effect the opening of said contacts substantially always during the presence of current in said HID lamp.

2. The auxiliary lighting control circuit of claim 1 further comprising a low-voltage power supply providing a positive and a negative d.c. regulated voltage rail.

3. The auxiliary lighting control circuit of claim 2 wherein said low-voltage power supply comprises:

first and second input terminals adapted to be connected to a source of a.c. power providing an a.c. line voltage;

a capacitor connected to said first input terminal for impedance reducing said a.c. line voltage;

Zener diode means connected between said capacitor and said second input terminal for clamping said a.c. line voltage to a predetermined value providing a regulated a.c. voltage;

diode means for peak-detecting the line voltage to thereby provide essentially independant positive and negative d.c. regulated voltage supplies that selectively provide a low current where low ripple is required and a higher current when higher ripple can be tolerated while minimizing the size and cost of filter capacitors.

4. The auxiliary lighting control circuit of claim 3 wherein said solid state control circuit includes transistors; and wherein said low-voltage regulated power supply includes a resistor connected to one of said input terminals for limiting line transients and current surges to thereby protect said transistors from line transients and current surges.

5. The auxiliary lighting control circuit of claim 2 wherein said solid state control circuit includes a high gain, low input impedance a.c. amplifier operatively connected to said secondary winding for producing a rectangular rail-to-common waveform, said amplifier including means for reducing high frequency noise.

6. The auxiliary lighting control circuit of claim 1 wherein said solid state control circuit includes a first time delay to delay the application of power to said electromagnetic relay during cold start of said HID lamp, said first time delay being longer in duration than the normal time interval between the application of said a.c. power to said HID lamp in a cold condition and the passage of current through said HID lamp.

7. The auxiliary lighting control circuit of claim 6 further comprising a low-voltage power supply providing a positive and a negative d.c. regulated voltage rail wherein said first time delay is effected by a first time delay means comprising a first capacitive means coupled to said positive d.c. voltage rail and resistively coupled to circuit common, said capacitive means being charged to a voltage greater than a predetermined value to effect the application of power to said electromagnetic relay.

8. The auxiliary lighting control circuit of claim 6 further comprising means for overriding said first time delay.

9. The auxiliary lighting control circuit of claim 8 wherein said first time delay is effected by a first time delay means comprising a first capacitive means coupled to said positive d.c. voltage rail and resistively coupled to circuit common, said first capacitive means being charged to a voltage greater than a predetermined value to effect the application of power to said electromagnetic relay, and wherein said overriding means comprises a switch coupled between circuit common and said first capacitive means, said switch being conductive when a.c. line voltage is applied for cold start of said HID lamp to effect the charging of said first capacitive means to a voltage greater than said predetermined value before the passage of current through said HID lamp.

10. The auxiliary lighting control circuit of claim 1 wherein said solid state control circuit includes a second time delay to delay the opening of said relay contacts during the presence of current in said HID lamp.

11. The auxiliary lighting control circuit of claim 10 further comprising a low-voltage power supply providing a positive and a negative d.c. regulated voltage rail wherein said time delay is effected by a second time delay means comprising a second capacitive means coupled to said positive d.c. voltage rail and resistively coupled to circuit common, said second capacitive means being charged to a voltage greater than a predetermined value to effect the application of power to said electromagnetic relay to close said contacts during the absence of current through said HID lamp, and being discharged to a voltage less than said predetermined value to prevent the application of power to said electromagnetic relay to open said contacts during the presence of current through said HID lamp, wherein opening of said contacts is delayed during the presence of current through said HID lamp until said second capacitive means discharges to a voltage below said predetermined value.

12. The auxiliary lighting control circuit of claim 3 wherein said solid state control circuit comprises a positive feedback means to prevent chatter of said electromagnetic relay due to said current ripple.

13. The auxiliary lighting control circuit of claim 1 wherein said solid state control circuit includes a time delay and filter to eliminate false turn-on of the auxiliary lamp due to starting pulses and spurious glow currents.

14. The auxiliary lighting control circuit of claim 6 further including a second time delay to delay the opening of said relay contacts during the presence of current in said HID lamp.

15. The auxiliary lighting control circuit of claim 14 further comprising a low-voltage power supply providing a positive and a negative d.c. regulated voltage rail wherein said second time delay is effected by a second time delay means comprising a second capacitive means coupled to said positive d.c. voltage rail and resistively coupled to circuit common, said second capacitive means being charged to a voltage greater than a predetermined value to effect the application of power to said electromagnetic relay to close said contacts during the absence of current through said HID lamp, and being discharged to a voltage less than said predetermined value to prevent the application of power to said electromagnetic relay to open said contacts during the presence of current through said HID lamp, wherein opening of said contacts is delayed during the presence of current through said HID lamp until said second capacitive means discharges to a voltage below said predetermined value.

16. The auxiliary lighting control circuit of claim 15 wherein said first time delay is effected by a first time delay means comprising a first capacitive means coupled to said positive d.c. voltage rail and resistively coupled to circuit common, said capacitive means being charged to a voltage greater than a predetermined value to effect the application of power to said electromagnetic relay.

17. The auxiliary lighting control circuit of claim 16 wherein said first capacitive means and said second capacitive means each comprise a single capacitor, said capacitor being common to both capacitive means.

18. The auxiliary lighting control circuit of claim 1 wherein said solid state control circuit includes a detector and a relay driver to effect the application of power to said electromagnetic relay and to prevent the application of power to said electromagnetic relay, said detector operating in a conductive state during the presence of current in said HID lamp and being in a non-conductive state during the absence of current in said HID lamp, and said relay driver being substantially always in a non-conductive state when said detector is in a conductive state to prevent the application of power to said electromagnetic relay and operating in a conductive state when said detector is in a non-conductive state to effect the application of power to said electromagnetic relay.

19. The auxiliary lighting control circuit of claim 18 further comprising a low-voltage power supply providing a positive and a negative d.c. regulated voltage rail wherein said solid state control circuit includes a high gain, low input impedance a.c. amplifier operatively connected to said secondary winding for producing a rectangular rail-to-common waveform, wherein said detector comprises transistive means operatively coupled between said positive d.c. voltage rail and circuit common and to said a.c. amplifier to operate in a conductive state when said rail-to-common waveform is produced.

20. The auxiliary lighting control circuit of claim 18 further comprising a low-voltage power supply providing a positive and a negative d.c. regulated voltage rail wherein said solid state control circuit includes a high gain, low input impedance a.c. amplifier operatively connected to said secondary winding for producing a rectangular rail-to-common waveform, wherein said relay driver comprises transistive means operatively coupled in series with said electromagnetic relay between said positive d.c. voltage rail and circuit common.

21. In an auxiliary lighting control circuit for a lighting system having a HID lamp as a primary light source and an auxiliary light source for providing light when said HID lamp is extinguished or below full brightness but power is available to the system comprising a current transformer having a primary winding connected in series with said HID lamp and an a.c. power source, and a secondary winding providing an a.c. current proportional to the current in said HID lamp; and an electromagnetic relay operating in a conductive state to energize an auxiliary lighting source when said a.c. current is less than a predetermined value, said relay operating substantially always in a non-conductive state when said a.c. current is greater than said predetermined value to deenergize said auxiliary lighting source;

wherein the improvement comprises:

a solid state control circuit activating said relay to a conductive state when said a.c. current is less than said predetermined value and deactivating said relay to operate in a non-conductive state when said a.c. current is substantially always greater than said predetermined value.

22. An auxiliary lighting control circuit comprising:

(a) two input terminals adapted to receive a.c. power;

(b) a low-voltage power supply connected to said input terminals and providing a positive and a negative regulated d.c. voltage rail;

(c) a current transformer comprising a primary winding series connected with an HID lamp and an a.c. power source, and a secondary winding providing an a.c. current proportional to the current in said HID lamp;

(d) an a.c. amplifier operatively coupled to said secondary winding providing an HID lamp current sense signal when said a.c. current is greater than a predetermined value;

(e) a detector operating in a conductive state when said HID lamp current sense signal is provided by said a.c. amplifier and being in a non-conductive state in the absence of said HID lamp current sense signal;

(f) a relay driver being substantially always in a non-conductive state when said detector is in a conductive state and operating in a conductive state when said detector is in a non-conductive state; and (g) a relay activated to a conductive state to energize an auxiliary lighting source when said relay driver is in a conductive state and deactivated to a non-conductive state to deenergize said auxiliary lighting source when said relay driver is in a non-conductive state.

23. The auxiliary lighting control circuit of claim 22 further comprising a first time delay means delaying the operation of the relay driver in a conductive state during cold start of said HID lamp for a time period longer in duration than the normal time interval between the application of said a.c. power to said HID lamp in a cold condition and the operation of said detector in a conductive state.

24. The auxiliary lighting control circuit of claim 23 wherein said first time delay means comprises a first capacitive means coupled to said positive d.c. voltage rail and resistively coupled to said negative d.c. voltage rail, said first capacitive means being charged to a voltage greater than a predetermined value to effect operation of said relay driver in a conductive state.

25. The auxiliary lighting control circuit of claim 22 further comprising means for overriding said first time delay means.

26. The auxiliary lighting control circuit of claim 25 wherein said first time delay means comprises a first capacitive means coupled to said positive d.c. voltage rail and resistively coupled to circuit common, said first capacitive means being charged to a voltage greater than a predetermined value to effect the operation of said relay driver in a conductive state wherein said overriding means comprises a switch coupled between circuit common and said first capacitive means, said switch being conductive when a.c. line voltage is applied for cold start of said HID lamp to effect the charging of said first capacitive means to a voltage greater than said predetermined value before said detector operates in a conductive state.

27. The auxiliary lighting control circuit of claim 22 further comprising a second time delay means delaying said relay driver from being in a non-conductive state when said detector operates in a conductive state.

28. The auxiliary lighting control circuit of claim 27 wherein said second time delay means comprises a second capacitive means coupled to said positive d.c. voltage rail and resistively coupled to circuit common, said second capacitive means being charged to a voltage greater than a predetermined value to effect the operation of said relay driver in a conductive state when said detector is in a non-conductive state and being discharged to a voltage less than said predetermined value to effect the relay driver being in a non-conductive state when said detector operates in a conductive state wherein said relay driver operates in a conductive state when said detector operates in a conductive state until said second capacitive means discharges to a voltage below said predetermined value.

29. The auxiliary lighting control circuit of claim 23 further including a second time delay means delaying said relay driver from being in a non-conductive state when said detector operates in a conductive state.

30. The auxiliary lighting control circuit of claim 29 wherein said first time delay means comprises a first capacitive means coupled to said positive d.c. voltage rail and resistively coupled to circuit common, said first capacitive means being charged to a voltage greater than a predetermined value to effect operation of said relay driver in a conductive state.

31. The auxiliary lighting control circuit of claim 30 wherein said second time delay means comprises a second capacitive means coupled to said positive d.c. voltage rail and resistively coupled to circuit common, said second capacitive means being charged to a voltage greater than a predetermined value to effect the operation of said relay driver in a conductive state when said detector is in a non-conductive state and being discharged to a voltage less than said predetermined value to effect the relay driver being in a non-conductive state when said detector operates in a conductive state wherein said relay driver operates in a conductive state when said detector operates in a conductive state until said second capacitive means discharges to a voltage below said predetermined value.

32. The auxiliary lighting control circuit of claim 31 wherein said first capacitive means is said second capacitive means.

33. An auxiliary lighting control circuit operating to effect the application of power to an electromagnetic relay to effect the closing of relay contacts to energize an auxiliary light source substantially always during the absence of current passing through a HID lamp, and to prevent the application of power to said relay to thereby effect the opening of said relay contacts to deenergize said auxiliary lighting source substantially always during the passage of current through said HID lamp, said circuit comprising a capacitive means providing:

(a) a first time delay to delay the closing of said relay contacts during cold start of said HID lamp, said first time delay being longer in duration than the normal time interval between the application of a.c. power to said HID lamp in a cold condition and the passage of current through said HID lamp; and (b) a second time delay to delay the opening of said relay contacts during the passage of current through said HID lamp.

34. A method of providing auxiliary light in a HID lighting system comprising the steps of:

(a) sensing the current in the HID lamp with a current transformer;

(b) providing a solid state control circuit operatively connected to said current transformer and to an a.c. power source to effect the application of power to an electromagnetic relay to thereby effect the closing of relay contacts series connected to said auxiliary light source to energize said auxiliary light source substantially always when the current in said HID lamp is less than a predetermined value, and to prevent the application of power to said electromagnetic relay to effect the opening of said relay contacts to deenergize said auxiliary light source substantially always when the current in said HID lamp is greater than a predetermined value.

35. The method of claim 34 wherein the step of sensing the current in said HID lamp comprises the steps of:

providing a current transformer primary winding series connected to said HID lamp; and providing a current transformer secondary winding operatively connected to said solid state control circuit having a current proportional to the current in said primary winding.

36. The method of claim 34 further comprising the step of:

(c) providing a first time delay to delay the application of power to said electromagnetic relay during cold start of said HID lamp, said first time delay being longer in duration than the normal time interval between the application of said a.c. power to said HID lamp in a cold condition and the passage of current greater than said predetermined value through said HID lamp.

37. The method of claim 34 further comprising the step of:

(c) providing a second time delay to delay the opening of said relay contacts during the passage of current greater than said predetermined value through said HID lamp.

38. The method of claim 37 further comprising the step of:

(c) providing a first time delay to delay the application of power to said electromagnetic relay during cold start of said HID lamp, said first time delay being longer in duration than the normal time interval between the application of said a.c. power to said HID lamp in a cold condition and the passage of current greater than said predetermined value through said HID lamp.

39. The method of claim 38 further comprising the step of:

(d) providing said first and second time delays with a single capacitive means operatively connected in said solid state control circuit.

40. A method of controlling an auxiliary lamp to energize substantially always when the current passing through an HID lamp is below a predetermined value and to deenergize substantially always when said current is greater than said predetermined value comprising the step of providing a capacitive means operatively connected in a solid state controller to provide:

(a) a first time delay to delay energizing said auxiliary lamp during cold start of said HID lamp, said first time delay being longer in duration than the normal time interval between the application of said a.c. power to said HID lamp in a cold condition and the passage of current greater than said predetermined value through said HID lamp; and (b) a second time delay to delay deenergizing said auxiliary lamp during the passage of current greater than said predetermined value through said HID lamp.

41. The auxiliary lighting control circuit of claim 21 further comprising a first time delay means for delaying the operation of said relay in a conductive state during cold start of said HID lamp for a time period longer in duration than the normal time interval between the application of the a.c. power to said HID lamp in a cold condition and presence of said a.c. current greater than said predetermined value.

42. The auxiliary lighting control circuit of claim 41 further comprising a second time delay means for delaying the operation of said relay in a non-conductive state for a time period of a predetermined duration when said a.c. current is greater than said predetermined value.

43. The auxiliary lighting control circuit of claim 21 further comprising a second time delay means for delaying the operation of said relay in a non-conductive state for a time period of a predetermined duration when said a.c. current is greater than said predetermined value.

44. The auxiliary lighting control circuit of claim 33 further comprising a current transformer having (i) a primary winding series connected with said HID lamp and an a.c. power source, and (ii) a secondary winding providing an a.c. current proportional to the current in said HID lamp, wherein said auxiliary lighting control circuit operates (i) to effect the application of power to said relay substantially always when said a.c. current is less than a predetermined current magnitude, and (ii) to prevent the application of power to said relay when said a.c. current is substantially always greater than a predetermined current magnitude.

45. The auxiliary lighting control circuit of claim 44 further comprising a solid state control circuit operating to (i) effect the application of power to said relay responsive to the absence of said a.c. current at a magnitude greater than said predetermined current magnitude, and (ii) prevent the application of power to said relay responsive to the presence of said a.c. current at a magnitude greater than said predetermined current magnitude.

46. The auxiliary lighting control circuit of claim 45 further comprising a low voltage d.c. power supply for providing power to said relay to thereby effect the closing of said relay contacts.

47. The auxiliary lighting control circuit of claim 33 further comprising a low voltage d.c. power supply for providing power to said relay to thereby effect the closing of said relay contacts.

48. The auxiliary lighting control circuit of claim 33 wherein said capacitive means comprises a single capacitor.

* * * * *